US006203289B1

(12) United States Patent
Castel et al.

(10) Patent No.: US 6,203,289 B1
(45) Date of Patent: Mar. 20, 2001

(54) HYDRAULIC ALTERNATING VOLUMETRIC PUMPING SYSTEM

(75) Inventors: Yvon Castel, Croissy sur Seine; Jacques Corteville, Rueil Malmaison, both of (FR)

(73) Assignee: Institut Francais du Petrole, Rueil-Malmaison cedex (FR)

( * ) Notice: Subject to any disclaimer, the term of this patent is extended or adjusted under 35 U.S.C. 154(b) by 0 days.

(21) Appl. No.: 09/095,022

(22) Filed: Jun. 9, 1998

(30) Foreign Application Priority Data

Jun. 9, 1997 (FR) ..... 97 07212

(51) Int. Cl.[7] ..... F04B 35/02; F04B 17/00
(52) U.S. Cl. ..... 417/385; 417/401
(58) Field of Search ..... 417/401 F, 385 F

(56) References Cited

U.S. PATENT DOCUMENTS 1,981,288 * 11/1934 Ross ..... 417/401
2,467,413 * 4/1949 Wildhack ..... 417/401
2,909,315 * 10/1959 Sampietro ..... 417/401
3,362,618 * 1/1968 Fortinov ..... 417/401

FOREIGN PATENT DOCUMENTS 0151092 8/1985 (EP) ..... F04B/47/00
2236381 1/1975 (FR) ..... F04B/43/00

* cited by examiner

*Primary Examiner*—William Wayner
(74) *Attorney, Agent, or Firm*—Antonelli, Terry, Stout & Kraus, LLP

(57) ABSTRACT

Pumping system for pumping fluids at low pressure comprising a pumping enclosure connected to a pipe 16 introducing the fluid to be pumped and a pipe 18 discharging the pumped fluid.

The enclosure is connected to a pipe introducing a drive fluid and a reducer (P1, P2) of the drive fluid pressure transmitted to the pumped fluid.

13 Claims, 10 Drawing Sheets

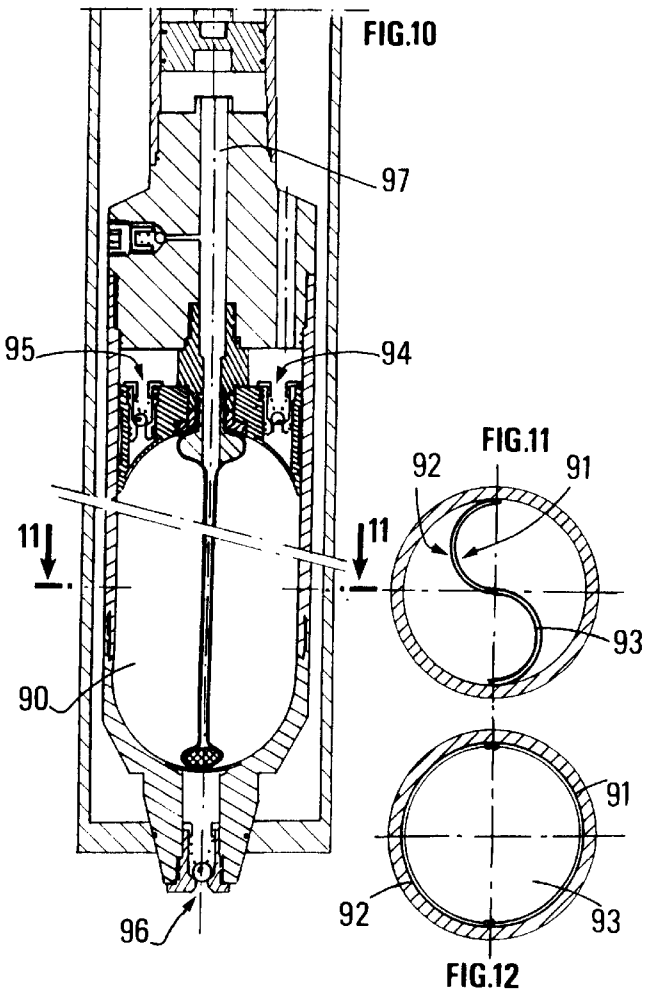
FIG.10
97
94
95
11
11
90
96
FIG.11
91
92
93
FIG.12
91
92
93
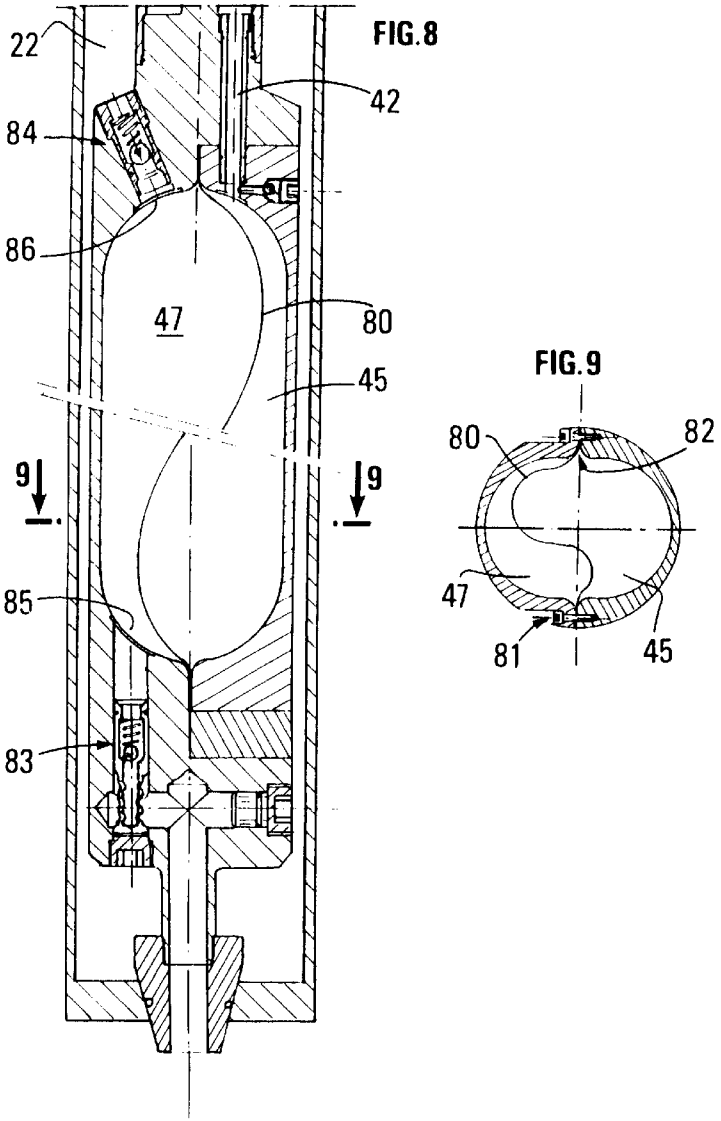
FIG.8
42
80
45
9
9
47
22
84
86
85
83
FIG.9
82
45
80
81
47

2
3
47
19
47
19
47

HYDRAULIC ALTERNATING VOLUMETRIC PUMPING SYSTEM

BACKGROUND OF THE INVENTION

1. Field of the Invention

The present invention relates to a hydraulic pumping system particularly for pumping fluids at low pressure and in particular for pumping petroleum fluids at the bottom of a well.

2. Description of the Prior Art

Various methods and devices are used in the field of hydrocarbon production for pumping low-pressure fluids.

Classical hydraulic pumping by jet or piston type bottom-hole pumps requires, for example:

- either lifting the drive fluid mixed with the product through the annular gap between the casing and the tubing, or through the central tubing, depending on the method of hydraulic circulation chosen. The drive fluid is, for example, the water in the deposit or a degassed, processed crude that may contain additives and/or solvents, avoiding problems of fouling, emulsion, or rusting. One of the drawbacks of this method is that the mixture of drive liquid and product fluid can lead to cross-pollution of these two fluids. This option demands a voluminous and expensive processing facility at the surface to filter and recycle the drive fluid;
- or using a well completion with an extra tubing for lifting the expanded drive fluid, which is an expensive and complex option when reduced to practice.

The present invention injects and recovers the drive fluid through one and the same pipe, alternating the drive fluid injection and removal phases in regular cycles. Using two different bottom/surface hydraulic links for the drive fluid and the pumped fluid prevents mixing of the drive fluid and product fluid during the pumping operation.

To implement the suction phase of the bottom-hole pump, the pressure generated at the bottom by the drive fluid is reduced so that it is below the well pressure at right angles to the pump suction.

Various methods have been described in the prior art for producing this pressure drop.

A first solution, described for example in U.S. Pat. Nos. 2,519,679, 3,941,510 and 4,405,891, consists of using a light drive fluid such as a liquid or a gas.

However, the use of low-density liquids (liquefied butane or propane, alcohol, etc.) does not produce a sufficient pressure for classical applications. The use of gas (natural gas or nitrogen) has the drawback of requiring substantial compression work with each cycle, leading to a very low energy efficiency and a very slow cycling rate.

A second solution, referred to for example in U.S. Pat. Nos. 2,180,366, 3,420,183, and 4,616,974, consists of assisting the suction phase of the pump by having the column of drive fluid and column of pumped fluid (assumed to be a liquid monophase) work alternately. This solution requires complicated machinery at the bottom and at the surface, comprising an assembly of check valves, pistons, and cylinders with different cross sections. This technique, which enables any drive fluid such as water to be used, is in this case well-suited for pumping water. On the other hand, production of crude with free gas, which represents a general application case of oil production, would require considerably increasing the volume of drive fluid transferred with each cycle to assist lifting the product by compressing the product gas, thus considerably limiting energy efficiency and production rate. Fitting a gas separator, whose efficiency is imperfect, to the suction end of the bottom-hole pump would complicate completion of the well without entirely eliminating this drawback.

Finally, a third solution, as described in U.S. Pat. Nos. 2,555,613 or 4,013,385, consists of using a mechanical or pneumatic spring directly applying an upward return force to the piston of a classical piston-type bottom-hole hydraulic pump. This solution faces the great difficulty of installing a long, powerful spring, which is necessary for substantially reducing the hydrostatic load produced by the drive fluid column, in a small-diameter space. The force P to be applied to resist this column must meet the condition:

$$F>(\rho_M gh-P_{suc})S$$

where:

$\rho_M$ is the density of the drive fluid, g represents the local gravity constant (approximately 9.8 $m/s^2$)

h is the pump depth $P_{suc}$ is the suction pressure of the fluid in the deposit, S is the section of the bottom-hole hydraulic pump piston.

The force P thus calculated would frequently exceed 1000 kg.

SUMMARY OF THE INVENTION

The present invention is a hydraulic pumping system that solves the problems referred to in the prior art while minimizing investment outlay and the cost of treating fluids at the surface.

The invention relates to a hydraulic alternating volumetric system for pumping fluids at low pressure comprising at least one pumping enclosure, said enclosure comprising at least one pipe for introducing the fluid to be pumped and at least one pipe for discharging the pumped fluid.

The pumping enclosure is provided with a pipe for introducing an auxiliary fluid such as a drive fluid and pressure-reducer for reducing the pressure of said drive fluid transmitted to the fluid to be pumped.

The pressure reducer together with the inside wall of the pumping enclosure can form a space which is reduced to a low pressure or a vacuum.

The invention can include means for preserving the vacuum in this space, said means comprising a vacuum-preserving check valve.

It is also possible to use an elastic seal to complement this valve, said seal being disposed such that it traps a small quantity of liquid in the evacuated space.

In this way, it is possible to maintain the vacuum or low pressure during operation, and the pressure reducer can carry out its function fully throughout the travel of the pressure reducer for as long as the system is operating.

It can also comprise a return connected to said pressure reducer.

According to one embodiment, the pumping enclosure has two parts, a first part and a second part, said parts being connected by a pipe, and:

- the first part or drive part has the pressure-reducer and can be provided with means for introducing drive fluid, with the drive fluid also playing the role of buffer fluid,
- the second part has for example a means playing the role of a piston and defining two variable-size chambers, one of the chambers being in communication with the pumped fluid introduction and a discharge and the other communicating with the drive fluid introduction pipe.

According to this arrangement, the free piston is controlled hydraulically by the drive fluid or buffer fluid.

The pressure reducer can have at least a first piston P1 with a section $S_1$ and a second piston P2 with a section $S_2$, the first and the second piston being disposed essentially along the same axis, and with the ratio $S_2/S_1$ between the sections being between 1 and 10 and preferably between 2 and 3.

Ignoring friction of the piston seals, the hydrostatic pressure thus transmitted to the pump comprising for example a free piston is reduced by a factor of $S_2/S_1$.

The pump function can also be formed by a deformable flexible membrane disposed essentially along the length of the pump or by a double membrane or, according to another embodiment, by one or more extensible membranes inflated and folded alternately to create, in the pump body, the changes in chamber volume necessary for the suction and discharge phases.

The pumping operations can be carried out using a device that controls and generates pressure cycles modulated at the surface. The drive fluid is for example a classical hydraulic oil or carefully filtered gas oil, or possibly water treated to prevent corrosion.

The pumping system according to the invention applies particularly well to bottom pumping of a petroleum-type effluent or possibly water from water-bearing deposits.

With respect to the hydraulic pumping systems according to the prior art, the present invention offers in particular the following advantages:

- the system is simple to build and operate,
- the check valves can advantageously be disposed at the upper part of the pump to favor initial expulsion of the free gas in the discharge phase of the pump, which improves pumping efficiency,
- the dead volumes at the intake can be minimized,
- since the risk of injecting substantial amounts of drive liquid into the deposit in the pumping phase is reduced, it is possible to dispense with a valve of the standing valve type normally used in classical hydraulic pumping,
- the assembly comprised of the pressure reducer and the bottom-hole pump can be installed in various ways, for example by suspending it from a coil tubing paid out from the surface, or by lowering it from an enclosure at the surface to the bottom simply by gravity inside a tubing of sufficient diameter, according to the technique of free hydraulic pumps.

In addition, for the pump options activated by a buffer hydraulic fluid:

- since the seals of the double jack and the pump are in contact with the drive liquid itself, the lifetime of the system is improved,
- the mechanical forces applied to the pump are minimized because the two pump chambers containing the drive liquid and the product are almost at the same pressures in the discharge phase and in the suction phase,
- it is not necessary to align the pump exactly coaxially in the double jack, which facilitates setting up the system, for example in the event of poor-quality completion.

BRIEF DESCRIPTION OF THE DRAWINGS

Other advantages and characteristics of the present invention will emerge from reading the description provided hereinbelow as exemplary embodiments in the framework of applications that are not limiting, with reference to the attached drawings wherein:

FIGS. 8 and 9 show schematically, in lengthwise and in cross section, the part of the bottom-hole pump equipped with a deformable membrane, FIGS. 10, 11, and 12 show schematically, in lengthwise and in cross section, the part of the bottom-hole pump having a double deformable membrane.

DESCRIPTION OF THE PREFERRED EMBODIMENTS

The description hereinbelow relates to a hydraulic pumping system used for bottom-hole pumping and which can be disposed inside a tubing or casing.

The expression "hydraulic alternating volumetric" designates a pumping system comprising a pump having chambers of alternately variable volume, depending on the quantity of effluents pumped or discharged, and a power transfer system using a hydraulic fluid, by comparison to a pumping system of the centrifugal or rotodynamic type.

For simplicity's sake, the expression "pumping system" designates hereinbelow a "hydraulic alternating volumetric pumping system."

The first hydraulic link between the bottom and the surface can be provided by a small-diameter tubing wherein a drive fluid is transferred alternately.

The second bottom-surface link for lifting the product or the crude pumped with the water and the associated gas can be comprised of the annular space between this tubing and a larger-diameter tubing, which can be formed by the casing.

This arrangement, normally used in this field, presents no impediment whatever to adopting the reverse direction of circulation to produce via the inside tubing, namely to pump the fluid up through this tubing.

The pumping system has a means for reducing the pressure of the drive fluid, which can be comprised of a double jack with two pistons P1 and P2 having sections of different sizes. The hydraulic drive liquid can be comprised of hydrocarbons such as gas oil, or by a special hydraulic liquid, or by the treated water. A first part of this drive liquid can serve as a buffer fluid for transmitting the drive pressure to the pump part of the bottom-hole pumping device.

Figure 1:
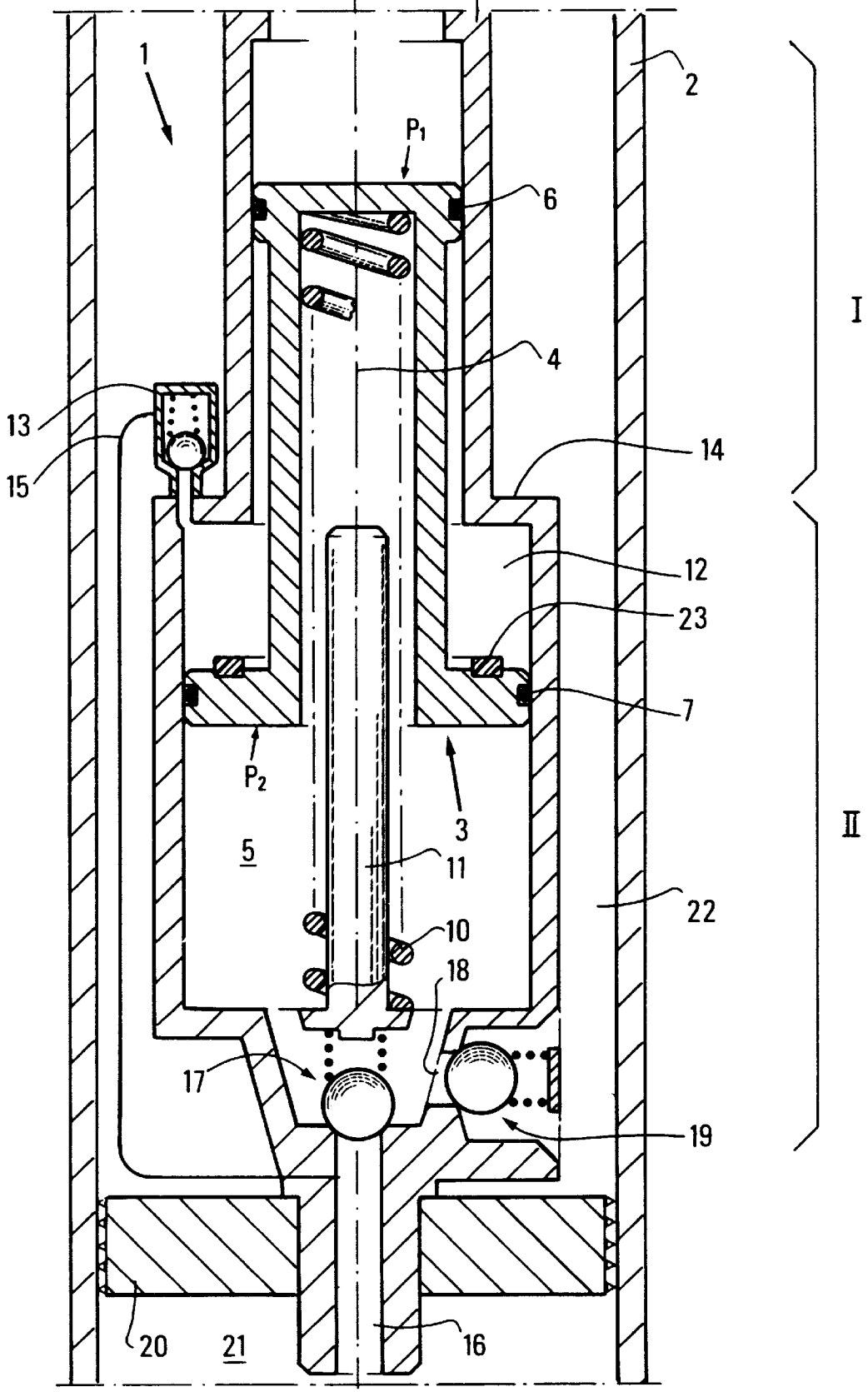
FIG. 1 shows the principle of a hydraulic pumping system according to the invention disposed inside a tubing, having a pressure reducer comprised of a double piston, with the larger-cross-section piston directly playing the role of product pumping piston.

FIG. 1 shows a pumping system comprising a cylindrical enclosure 1 which can have variations in section or diameter, having two parts I and II, the first part being equatable with a drive part and the second part II with a bottom-hole pump.

Part I of enclosure 1 is connected to a pipe 24 for introducing the drive fluid.

Inside this enclosure 1 is a means 3 for reducing the pressure of the drive fluid transmitted to the bottom-hole pump or part II, such as a double piston or double jack, comprising a piston P1 with section $S_1$ and a piston P2 with section $S_2$. Piston P1 is disposed in part I while piston P2 is located in the bottom-hole pump or part II in order to play the role of a pumping element and form a variable-volume pumping chamber 5 with the latter. The ratio between Sections $S_2$ and $S_1$ is preferably between 1 and 10, and preferably between 2 and 3. The two pistons P1 and P2 are connected by a hollow shaft 4 whose outside diameter is close to the inside diameter of part I of the system. In this way, the double piston forms a space 12 with the inside wall of the system, the volume of the space thus formed preferably being as small as possible. This space is preferably evacuated, or at a low air or nitrogen pressure, or at atmospheric pressure, whereby these conditions can be generated when production is started up.

Pistons P1 and P2 of pressure reducer 3 are equipped with gaskets 6 and 7 respectively, specially designed for operation of jacks at high pressures, such as the packings used in free-piston air-oil accumulators.

A mechanical spring 10 serving as an auxiliary means for returning piston P1 upward can be accommodated inside double piston 3. It can be comprised of a single spring or a stack of small springs in the shape of elastic washers, guided by an axial or cylindrical mechanical device 11.

The bottom-hole pump part has a suction pipe 16 equipped with a suction valve 17 and a discharge pipe 18 provided with a discharge valve 19.

The pumping device is disposed in casing 2, held by means 20 such as an anchoring system, and communicates with a deposit 21 through suction pipe 16.

The pumped fluid leaving discharge pipe 18 is lifted for example through space 22 formed by the inside wall of the casing and enclosure 1.

According to one embodiment, the vacuum of space 12 or its low pressure is maintained by a low-pressure valve 13, preferably mounted on part 14 separating the two parts I and II of enclosure 1. This valve 13 eliminates any small quantities of fluid present in evacuated space 12 during each pumping cycle, at the end of the double-jack pump-up phase, at the time when the volume of this evacuated space is smallest. Valve 13 is connected by a very thin tubing 15 to the suction pipe 16 of the pump to evacuate any leaks. This vacuum maintenance valve 13 can also be built into lower piston P2 of the double jack to allow elimination of fluids trapped in evacuated space 12 directly with the product via pumping chamber 5.

An elastic seal 23, a gasket or an O-ring for example, can be located on the upper surface of piston P2 to create a seal with connecting plate 14 of parts I and II (drive part and bottom-hole pump part) at the end of the upward travel. This enables any small volumes of liquid entering the evacuated space to be enclosed so that they can be eliminated by the drain valve before this fluid can reach the seal of the small piston of the double jack and thus totally fill the normally empty space, and enables the upward piston travel to be damped.

The space draining system associated with the upward return spring of the double piston of the pressure reducer makes expulsion of the trapped fluids through the drain valve more energetic. These return means, of the mechanical type (spring), pneumatic type (accumulator) or magnetic type (magnets) are preferably disposed below the pressure reducer. Leaving out friction and the low pressure gradients necessary for opening of the valves that draw product into the pump and evacuate the trapped fluids in the empty space of the double jack, the upward return force F of the return means must satisfy the condition:

$$F>(\rho_M gh-P_{suc})S$$

Where:

$\rho_M$ is the density of the drive fluid, g represents the local gravity constant (approximately 9.8 $m/s^2$)

h Is the pump depth $P_{suc}$ is the suction pressure of the fluid in the deposit, $S_1$ is the section of the small pressure reducer piston, $S_2$ is the section of the large pressure reducer piston.

Application of this formula shows that, for $S_2/S_1$ ratios greater than 2, with a drive fluid comprised of light gas oil, the return means is necessary only when the suction pressure of the deposit becomes low, for example at the end of the life of the deposit. In such a situation, application of the above formula shows that the return force necessary is some hundreds of kilograms, considerably less than the force P necessary to directly counterbalance the entire weight of the drive liquid column.

Moreover, these auxiliary return means, by reducing the pressure of the column of hydraulic fluid, can also contribute to speeding up the pumping rate by reducing the time the pumping chamber takes to fill in the suction phase.

The operating principle of the system can be explained for example by the following stages:

Part I of the enclosure is connected to a tubing 24 that brings the drive fluid into the double jack.

Thus, when the drive fluid is injected into enclosure 1 via tubing 24, double piston P1, P2 descends, suction valve 17 closes, discharge valve 18 opens, and the product is expelled to the surface through annular space 22. When the drive fluid is decompressed from the surface, piston P2 of the double jack rises, product suction valve 17 opens while discharge valve 19 closes, and the product coming from deposit 21 is drawn into pumping chamber 5 through anchoring system 20 of the pumping device through the suction pipe 16 of the pump.

Moreover, drive fluid circulation tubing 24 can be equipped with a lateral circulation valve (not shown in the figure) of the type classically used in petroleum production, installed at the bottom just above the pumping device for installation of the drive liquid and startup of the system. This tubing can also be equipped with a classical jar system to avoid mechanical stresses on the bottom-hole pumping system and its holding means and installation means in casing 2 due to variations in length of the drive fluid circulation tubing under the action of the modulated internal pressure.

Figure 2:
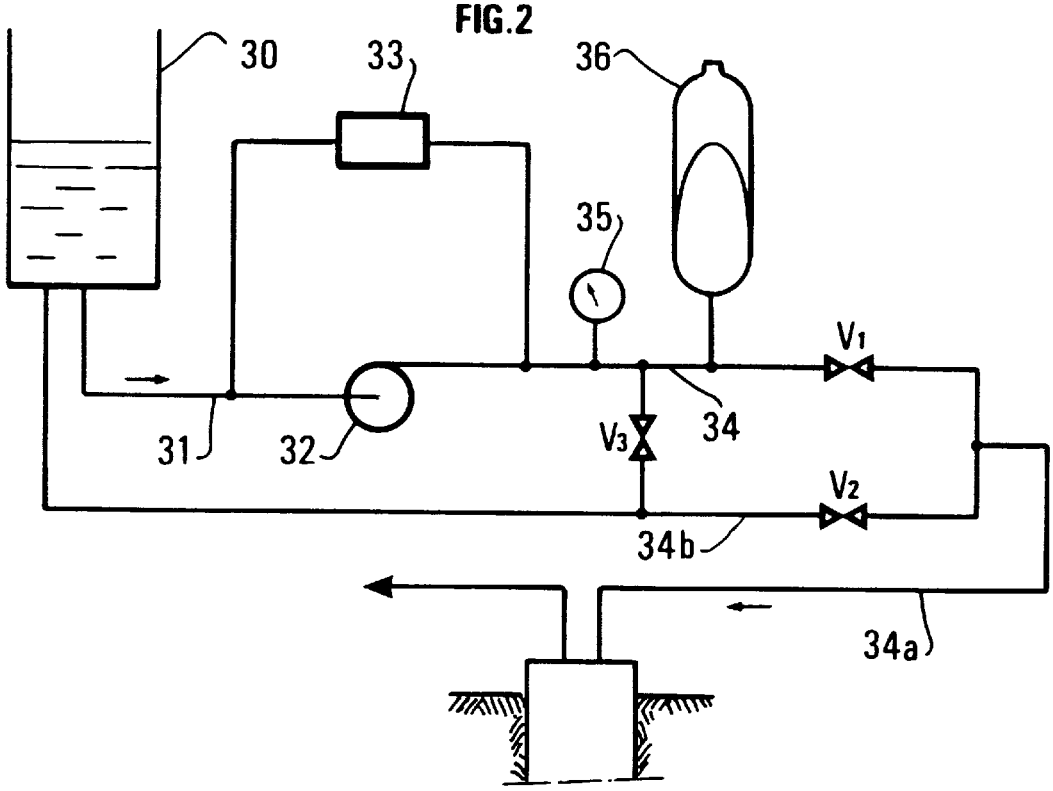
FIGS. 2, 3, and 4 show schematically examples of hydraulic power circuits at the surface for generating modulated-pressure cycles, and the shapes of these modulated-pressure cycles generated at the surface.
Figure 3:
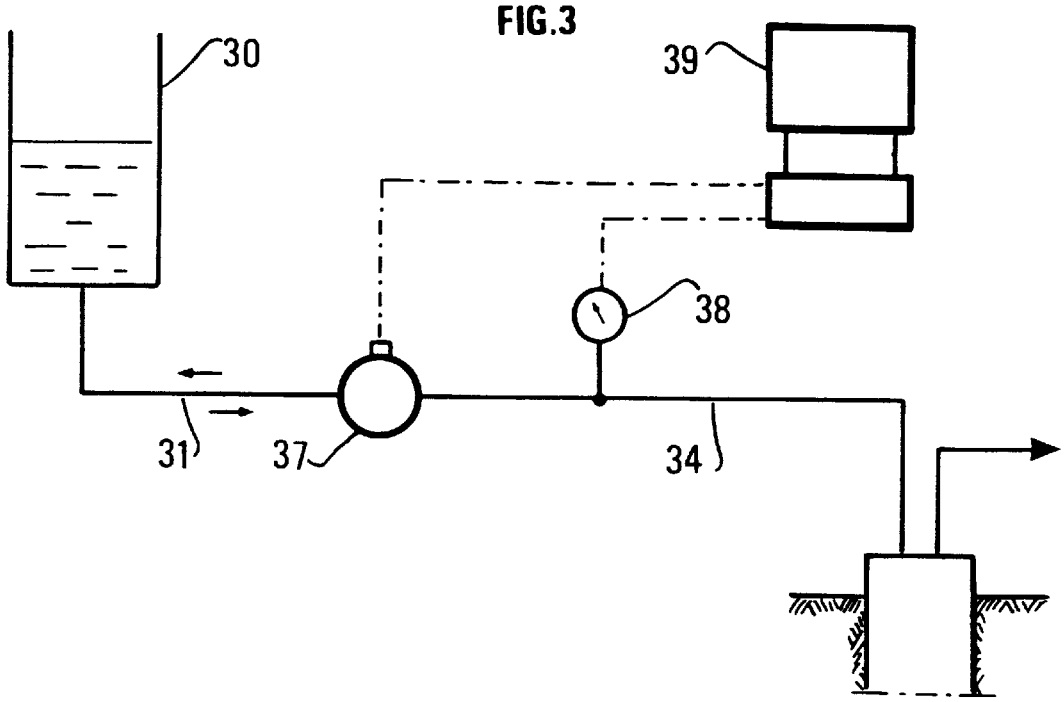

Implementation of the pumping system according to the invention is described in relation to FIGS. 2 and 3 which show two embodiments of the hydraulic circuit by which a drive pressure cycle can be generated in explanatory and nonlimiting fashion.

FIG. 2 shows schematically one embodiment of a hydraulic circuit by which the above-described cycles can be generated. The circuit has for example a reservoir 30 of drive liquid connected by a pipe 31 to an adjustable-flow pump 32 provided for example with a pressure limiter 33 connected in parallel. A pipe 34 divides for example into a first branch 34*a* connecting the output of pump 32 to the hydraulic pumping system drive fluid intake pipe. A pressure gauge 35 and an accumulator 36 enabling at least some of the energy unused in the drive fluid decompression phases to be recovered, if the pump is operating with constant delivery, are connected to the first branch. A second branch 34*b*, fitted with a valve V2, returns drive liquid to reservoir 30. The two branches 34*a* and 34*b* can be connected by a bypass valve V3 to facilitate restarting or stopping the pumping system. Valves V1 and V2, controlled by the pressures, with time delays to allow for high- and low-pressure plateaus in the cycles, then appropriately generate the various pressurization phases of the pipe.

Figure 4:
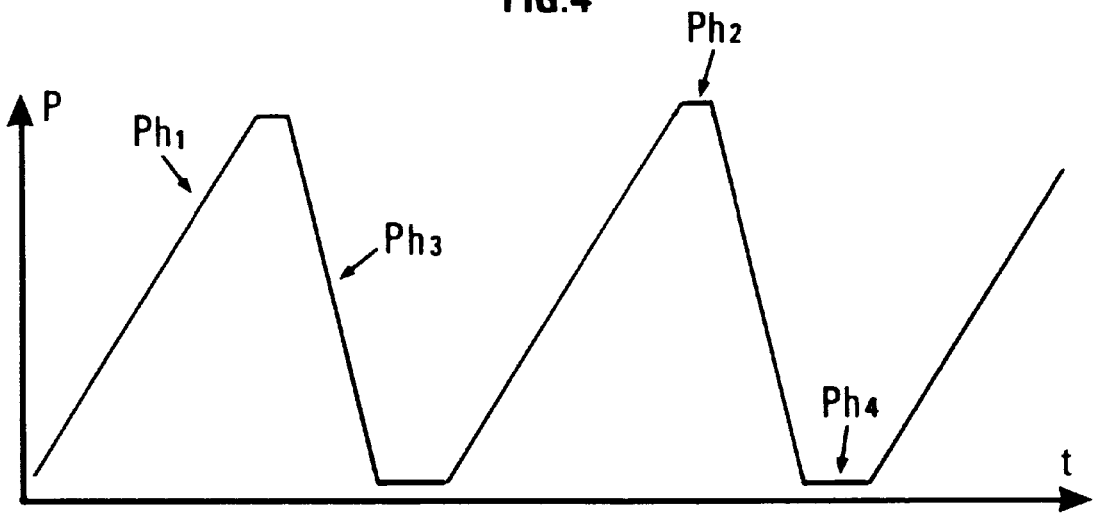

The pressure cycles generated at the surface schematically comprise four phases shown in a time vs. pressure diagram in FIG. 4:

- PH1, a drive liquid pressure rise phase whose duration depends mainly on the power of the surface pump,
- PH2, a phase in which the product that has entered the bottom-hole pump at substantially constant pressure is rapidly expelled,
- PH3, a phase of drive pressure reduction, which can also be rapid and which depends essentially on hydraulic pressure losses,
- PH4, a holding phase at minimum pressure, close to atmospheric pressure, to allow product to be admitted into the bottom-hole pump and whose duration must be sufficient for the bottom-hole pump to fill properly (part II of pumping system).

The pumping operation takes place discontinuously: the drive liquid is injected and withdrawn in modulated-pressure cycles, which are controlled from the surface and can be analyzed and optimized. The pressure of the drive liquid transferred to the bottom-hole pump is reduced at the bottom by the pressure reducer. When the value of the reduced drive pressure decreases and becomes less than the pressure of the deposit fluids at the pump intake, the fluid to be pumped is drawn into the pump. When the reduced pressure increases and exceeds the discharge pressure, the pumped fluid contained in the variable-volume chamber connected with the suction pipe is expelled through the discharge pipe and rises to the surface through the annular space between the pump body and the production casing or tubing.

The frequency of the cycles and hence the delivery rate of the bottom-hole pump can be regulated by adjusting, at the surface, the delivery rate of the drive liquid supply pump. The system can be controlled from the surface, for example by valves controlled by pressure sensors or by a slave hydraulic pump. The drive pressure cycles at the surface can be recorded as a function of time or of drive liquid flowrate and analyzed to read pumping performance and intervene if necessary.

Analysis of the shapes of the pressure cycles can reveal process problems such as possible wear in a system element.

The frequency of the pressure cycles and their extremes is preferably regulated so as to ensure that the bottom-hole pump is filled and emptied with no excess negative pressure or overpressure at the bottom. The process can be dimensioned, based on the use of a bottom-hole hydraulic volumetric pump, bearing in mind in particular the hydraulic and/or mechanical friction coefficients and the efficiency with which the bottom-hole pump body fills.

The same cycle-generating circuit may, without departing from the framework of the invention, be connected to several wells and thus allow simultaneous activation of these wells, preferably by adjusting their pressure cycles so that they are not in phase.

According to another embodiment, the modulated-pressure cycles can also be generated at the surface by a bi-directional variable-displacement hydraulic pump, as shown in FIG. 3. In this case, the drive liquid reservoir 30 is connected directly by pipe 31 to a high-power slave pump 37 which can operate in both directions. The pump outlet is connected to the drive fluid intake pipe of the pumping system by a single pipe 34. A pressure sensor 38 disposed at the outlet pipe of the pump advantageously enables the operations to be monitored.

In both cases, generation of the pressure cycles can be monitored with a microcontroller 39 which offers the particular advantage of being able to analyze each compression and decompression phase of the cycle with reference to previous conditions, for example to estimate the composition of the product (GOR at intake) and optimize its delivery.

In the case of corrosive fluid or crudes, the gaskets disposed at piston P2 can deteriorate rapidly and no longer fulfill their function.

Figure 5:
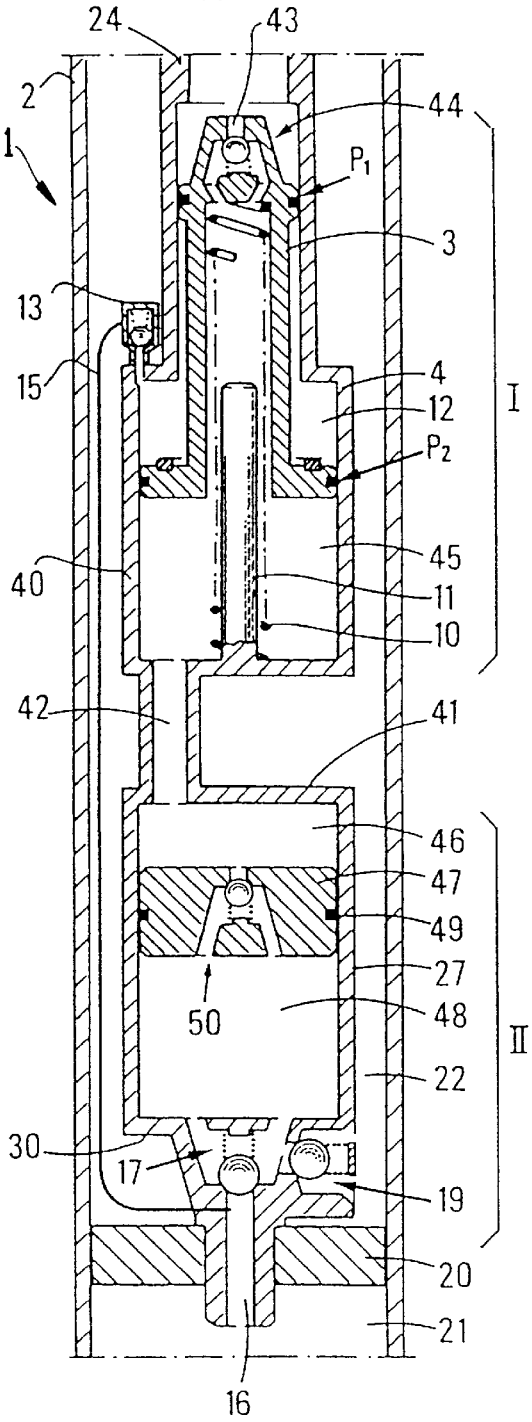
FIG. 5 shows a variant of a hydraulic pumping system having a pressure reducer and using a buffer fluid, comprising a "pressure reducer" part and a bottom-hole pump part, with the two parts being in communication.

To avoid this type of problem, FIG. 5 shows an alternative embodiment in which the system has two parts separated by a buffer fluid so that the gaskets of piston P2 are in contact with their own fluid (buffer fluid) instead of being in contact with the fluid produced.

FIGS. 5 to 13 describe various embodiments of the hydraulic pumping system described in FIG. 1, all of which have this two-part arrangement and use a buffer fluid. In the various embodiments, the drive and bottom-hole pump parts are decoupled and the buffer fluid is used as the drive fluid. It allows the power of the drive fluid to be transferred to the pump flexibly and with minimum friction.

FIG. 5 shows an alternative embodiment in which enclosure 1 has two parts, 40 and 41, connected for example by a pipe 42.

Part 40 comprises pressure reducing device 3, for example the double jack shown in FIG. 1. The elements common to this figure and FIG. 1 are not repeated.

For the hydraulic fluid to be introduced, piston P1 is connected to a pipe 43 and a valve 44 that allows the hydraulic buffer fluid to pass inside the axis of the hollow space in the double jack in flexible or rigid pipe 42 up to the upper surface of a free piston 47 of bottom-hole pump 41. Valve 44 is a calibrated valve subject to a steep pressure gradient (some tens of bars) attached to piston P1, inside or outside the latter.

Pipe 42, for example a connecting tube, is located at the end of part 40 near piston P2 and conveys drive fluid to part 41.

Part 41 represents the body of the bottom-hole pump. It is separated by free piston 47 into two chambers 46, 48 of variable volume. The piston can be fitted with gaskets 49 to provide a seal between the two chambers as it slides. The free piston can also be provided with a valve 50 for preserving the volume of buffer fluid introduced by the hydraulic fluid filling valve and filling the hollow space in the shaft of the double piston, a part of the buffer fluid pumping chamber, and variable-volume chamber 46.

The variable-volume product pumping chamber 48, comprised of the lower part of the body of pump 41 beneath free piston 47, has a volume that varies according to the position of piston P2 of the pressure reducer, which is hydraulically controlled by free piston 47 by means of the buffer fluid. The alternating operation of the pump, with opposite phases of opening and closing of product suction valve 17 and product discharge valve 19, is similar to that described for the option described above (FIG. 1).

When the drive fluid or drive liquid is introduced, piston P2 of the double jack abuts the bottom of part 40, and the free piston 47 of part 41, or pump, abuts the bottom of the pump.

The presence of calibrated valve 50 under a load slightly less than that of valve 44 (attached to piston P1) entrains any impurities or gas inclusions in the drive circuit, and constitutes protection against any overpressures during this filling operation. A certain quantity of buffer fluid is introduced through valve 44 so that valve 50 opens and allows the contaminated fluid to pass to the discharge pipe of the bottom-hole pump. The contaminated buffer fluid is evacuated through annular space 22. This valve may be disposed inside free piston 47, or possibly on the top of the body of pump 41.

Circulation of the drive liquid, with buffer liquid volume control, must be started when the pump is installed, then in the event of a deficit or excess of this buffer fluid, detected by the periodic analysis of pumping cycle performance at the surface.

The bottom-hole pump, in this embodiment, is a single-acting pump, in the lower position to simplify its installation and improve its efficiency. It is made of materials able to withstand the action of fluids such as hot, abrasive, and corrosive multiphase crudes.

Figure 6:
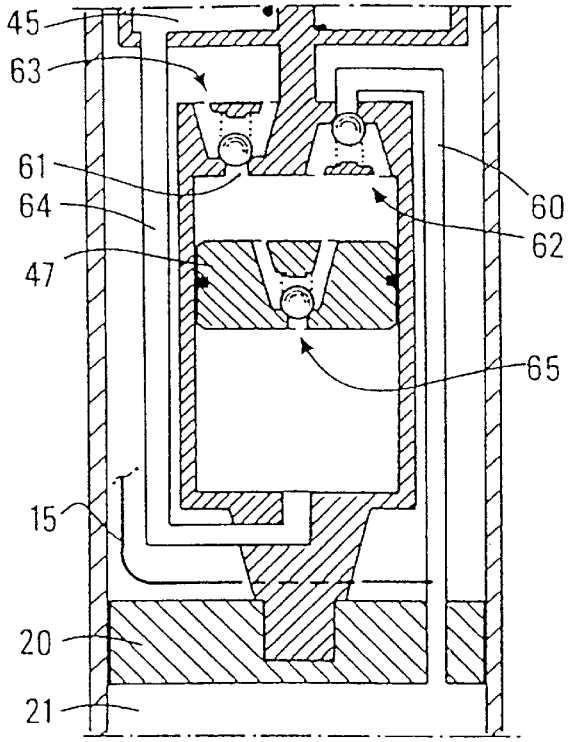
FIG. 6 shows an alternative arrangement of the valves of the bottom-hole pump part of the system in FIG. 5.
Figure 7:
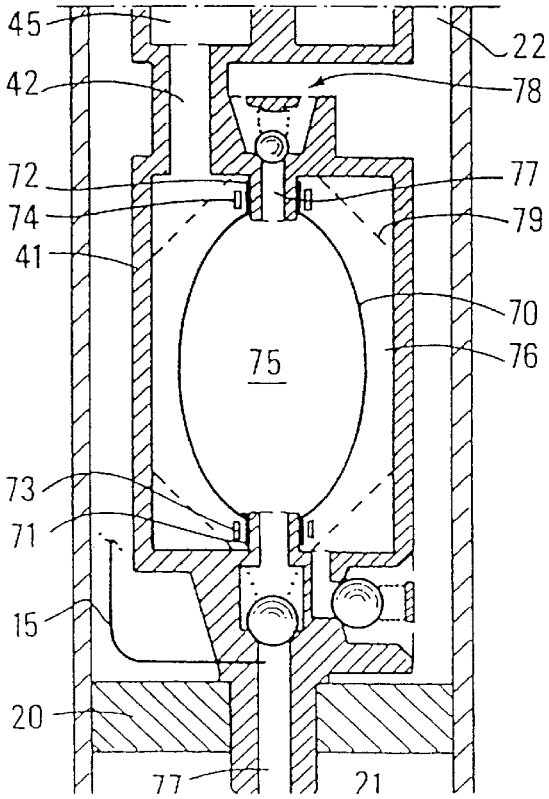
FIG. 7 shows a variant wherein the bottom-hole pump has a membrane delimiting a pumping chamber.

FIG. 6 shows a variant of the device in FIG. 5 where the suction and discharge, respectively a pipe 60, 61 and valve 62, 63, are disposed at the upper part of the pump body.

In this arrangement example, pipe 64 that provides the communication between the drive part and the bottom-hole pump part and conducts the drive hydraulic fluid, is connected to the lower part of the bottom-hole pump and the suction pipe 60, coming from deposit 21, rises along the pump body. The presence of these pipes requires a narrower pump body than that of the device in FIG. 1 due to the size of these pipes, which must be allowed for by elongating the pump body to achieve a match between pumping volume and the amount of buffer fluid that can be injected via the double jack.

Valve 65 that maintains the volume of buffer fluid is disposed at the level of the free piston opposite to the arrangement in FIG. 5 due to the positions of the suction and discharge pipes.

The top-position arrangement of discharge (61, 63) of the bottom-hole pump improves pumping efficiency in the presence of free gas.

Other embodiments of the pumping device are briefly described in FIGS. 7 to 13. They differ from FIG. 5 by the nature of the flexible interface playing the role of free piston and serving to generate the variable-volume chambers, and by the way in which the pump is installed or the direction of fluid circulation in the completion.

Due to the similarities to the preceding figures, only the parts of the figures showing the bottom-hole pump have been represented; they are all connected by a type 42 pipe to a drive part.

Free piston 47 is replaced by an impermeable, flexible, deformable membrane under the alternating action of suction and discharge of a hydraulic buffer fluid in order to constitute a variable-volume suction and discharge chamber.

Elastic membrane 70 can be made of a hydrocarbon-resistant synthetic elastomer.

A nitrile rubber could be used for cold temperatures reaching 110° to 130° C. A hydrogenated nitrile would enable operation up to 130 to 150° C. For higher temperatures, fluoropolymers of the Viton type should be chosen. The membrane can normally by cylindrical, disposed along the lengthwise axis of the pump and crimped at its two ends 71, 72 in adapters 73, 74 that communicate with the product suction and discharge valves, respectively. Elastic membrane 70 is disposed such as to define two variable-volume pumping chambers 75, and 76.

Variable-volume chamber 75 communicates with product intake pipe 72 and product discharge pipe 78 fitted with a valve 79. Discharge pipe 78 terminates in annular space 22.

Variable-volume chamber 76 is connected to the pipe that brings the buffer fluid of the pressure reducer to the bottom-hole pump.

Discharge pipe 75 and discharge valve 76 are for example disposed at the upper part of the pump body while suction pipe 77 and the suction valve are located opposite at the lower part as well as the buffer fluid volume maintenance valve.

The pump body can be provided with means 73 such as gratings protecting the membrane from damage as it inflates or retracts during pumping operations. The gratings can also be installed at connecting pipe 42 and on the suction and discharge pipes.

The shape of the pump body can also be chosen as a consequence, to limit deformation of the membrane in the buffer fluid filling and discharge phases.

FIGS. 8 and 9 show a cross section and lengthwise section 9—9 of a pumping system equipped with a flexible, deformable membrane creating a variable-volume pumping chamber inside a pump body of suitable shape, the entire pumping device being installed by suspending it from a coil tubing, the product being lifted through the annular space between the product tubing and the drive fluid circulation tubing.

Membrane 80 can be a piece of plane impermeable rubberized fabric. It is attached for example by its first side 81 and over the entire length of this first side to the inside wall of the pump body and by a second side 82 and over the entire length of this second side to an opposite spot on the inside wall of the pump body so as to form a variable-volume pumping chamber. The wall of the pump body in this case has a more complex shape in view of the deformation possibilities of a fabric structure.

The suction valve 83 and discharge valve 84 are equipped with gratings 85, 86 disposed at the inside wall of the pump body, having the particular function of limiting deformation of the membrane, for example preventing it from penetrating the suction or discharge pipe where it could be damaged. Such an intrusion could be due to a sudden and/or substantial variation in the pressure of the pumped fluid or buffer fluid.

FIGS. 10, 11, and 12 show a cross section and lengthwise section of another embodiment, where the single fabric membrane used above (FIG. 8) is replaced by a double membrane 90 of the same material. The double membrane is comprised of two distinct deformable interfaces 91, 92 to create a variable-volume chamber or space 93. Thus, in the discharge phase of the fluid pumped to the surface, parts 91 and 92 move apart, the volume of space 93 increases, and parts 91 and 92 are applied against the inside wall of the pump body (FIG. 12), while during the suction phase of the fluid to be pumped, parts 91 and 92 tend to move together and the chamber volume decreases (FIG. 11).

Parts 91 and 92 are attached to the lower and upper parts respectively of the pump body by appropriate means known to the individual skilled in the art and will not be described in detail once again.

The discharge valve or valves 94, 95 are for example disposed at the middle part of the pump. The suction and/or discharge valves 96 are preferably associated with gratings similar to gratings 85, 86 described in FIG. 8. Pipe 97 for introducing the buffer fluid and drive fluid is in communication with chamber 93 and is preferably disposed in the vicinity of the central axis of the system.

Figure 13:
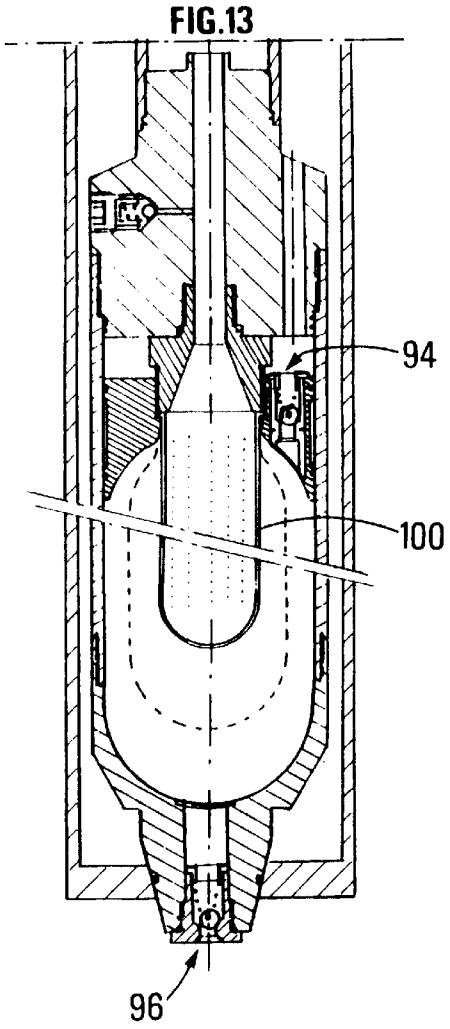
FIG. 13 shows an alternative embodiment of the bottom-hole pump comprising an elastic membrane able to expand or retract under the action of the modulated pressure of the drive fluid.

FIG. 13 shows a cross section of an alternative embodiment comprising an elastic membrane able to expand or retract under the action of the modulated pressure of the drive liquid. The pump body is provided with an extensible elastic membrane 100 of the goldbeater type, made for example of a synthetic hydrocarbon-resistant elastomer which inflates and deflates alternately in such a way as to vary the chamber volume in the pump body necessary for the suction and discharge phases. Here, the pump is suspended from the drive fluid transfer tubing and product lifting tubing through the annular space.

It is possible to use several bladders made of impermeable nonextensible materials overlapping so that the dead volume in the compression chamber is as small as possible. In this case, the suction and discharge valves are equipped with gratings such as those described above, with the particular function of protecting the membrane from deterioration, for example by limiting its travel and preventing it from penetrating the discharge pipe.

Figure 14:
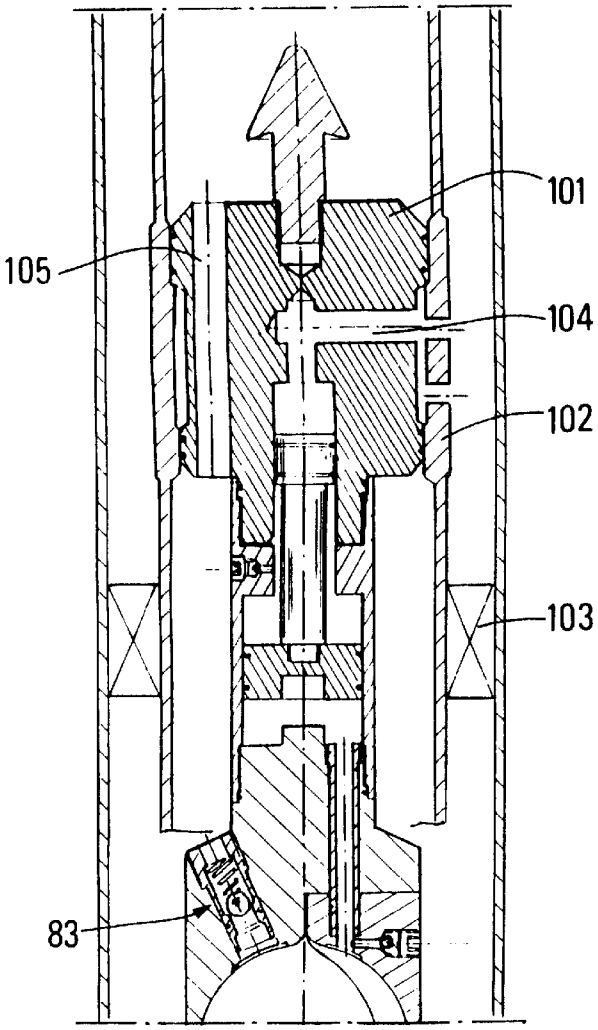
FIG. 14 shows schematically another embodiment comprising means for locating the entire system inside a producing well.
Figures 15A, 15B, 15C:
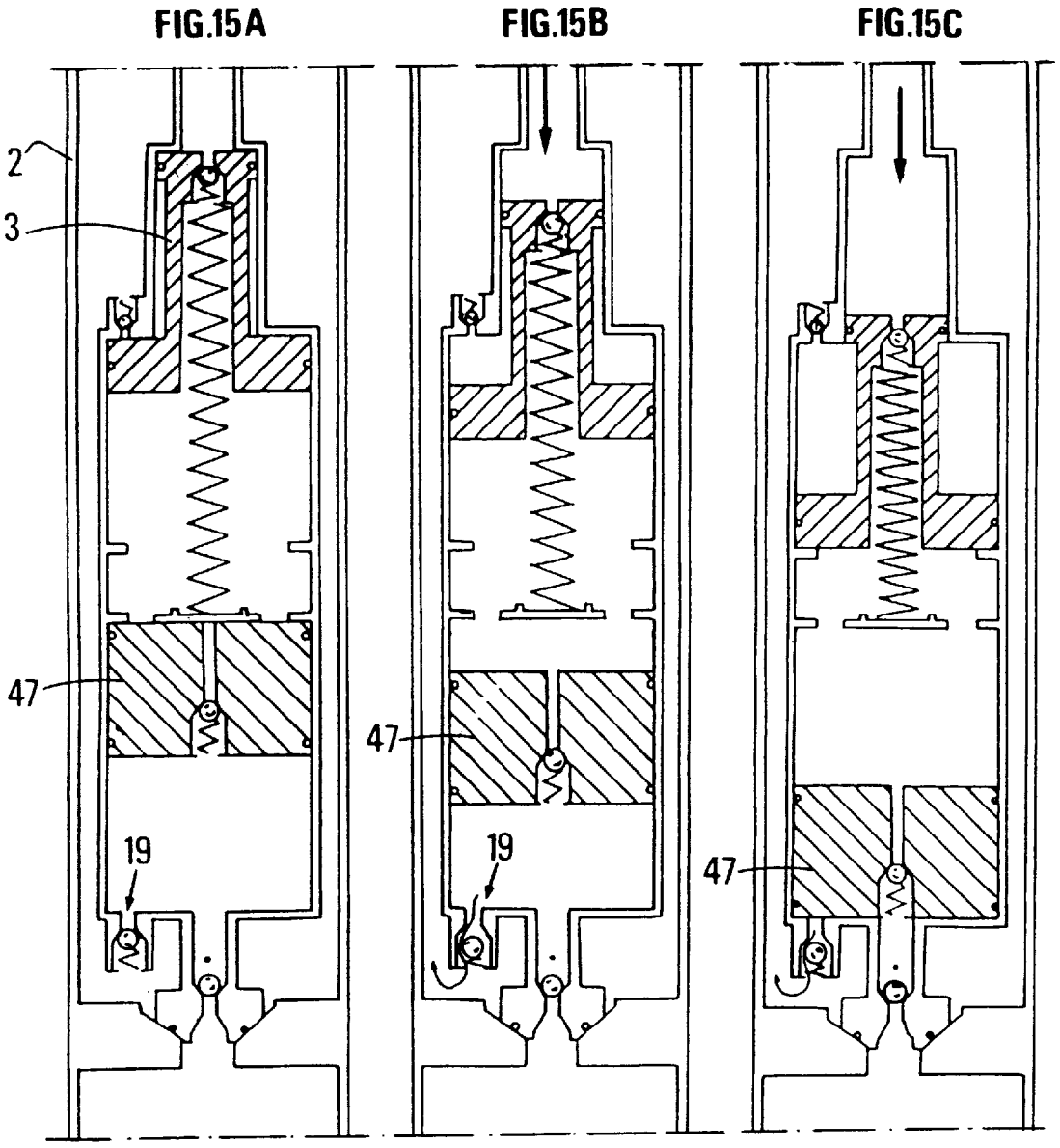
FIGS. 15A through 15F show schematically the principal normal operating stages of a free-piston pumping device.
Figure 15D:
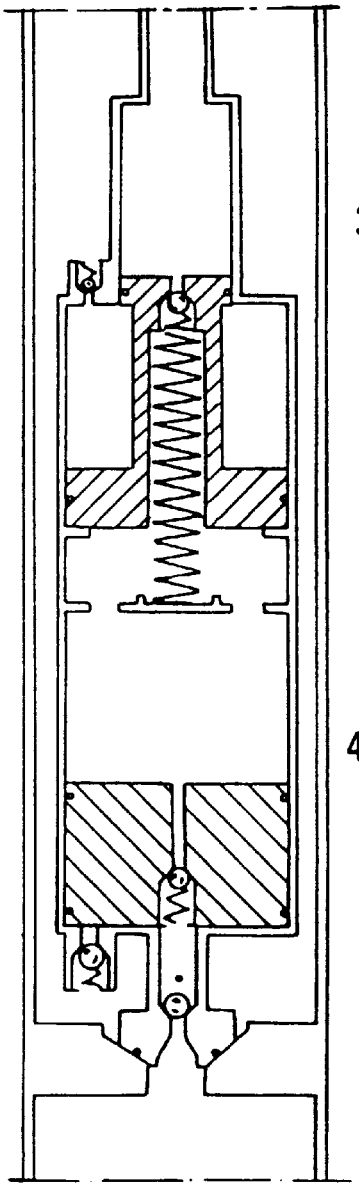
Figure 15E:
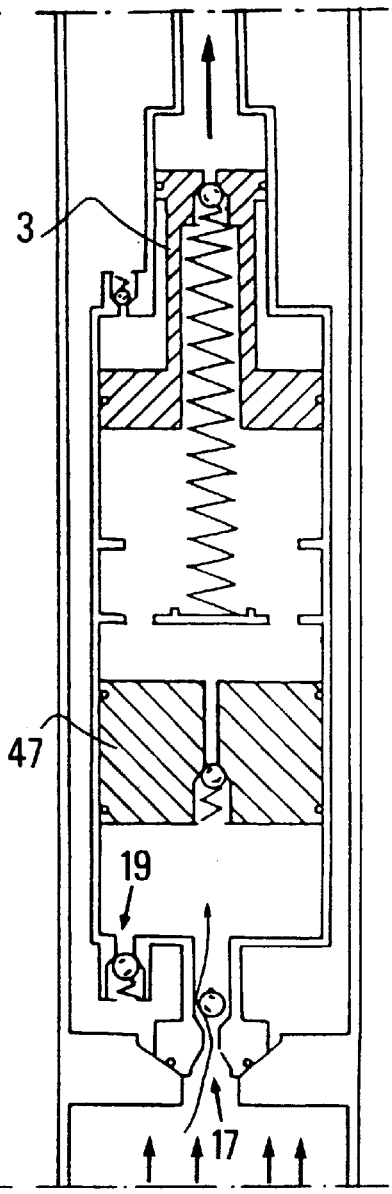
Figure 15F:
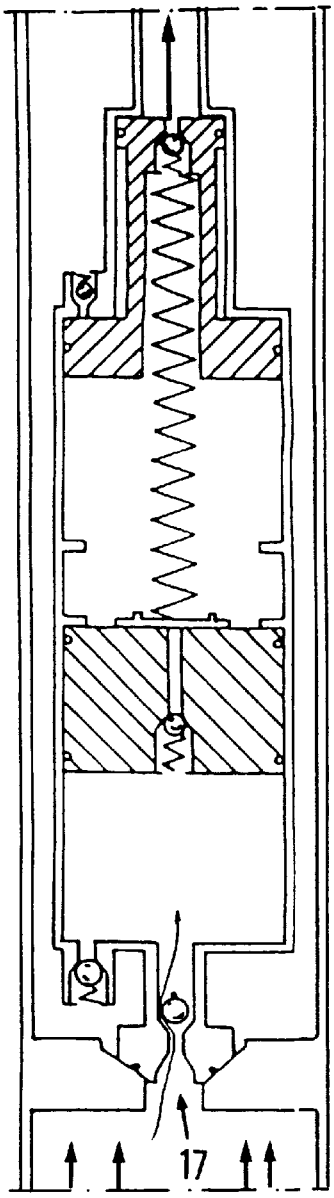
Figures 16A, 16B, 16C:
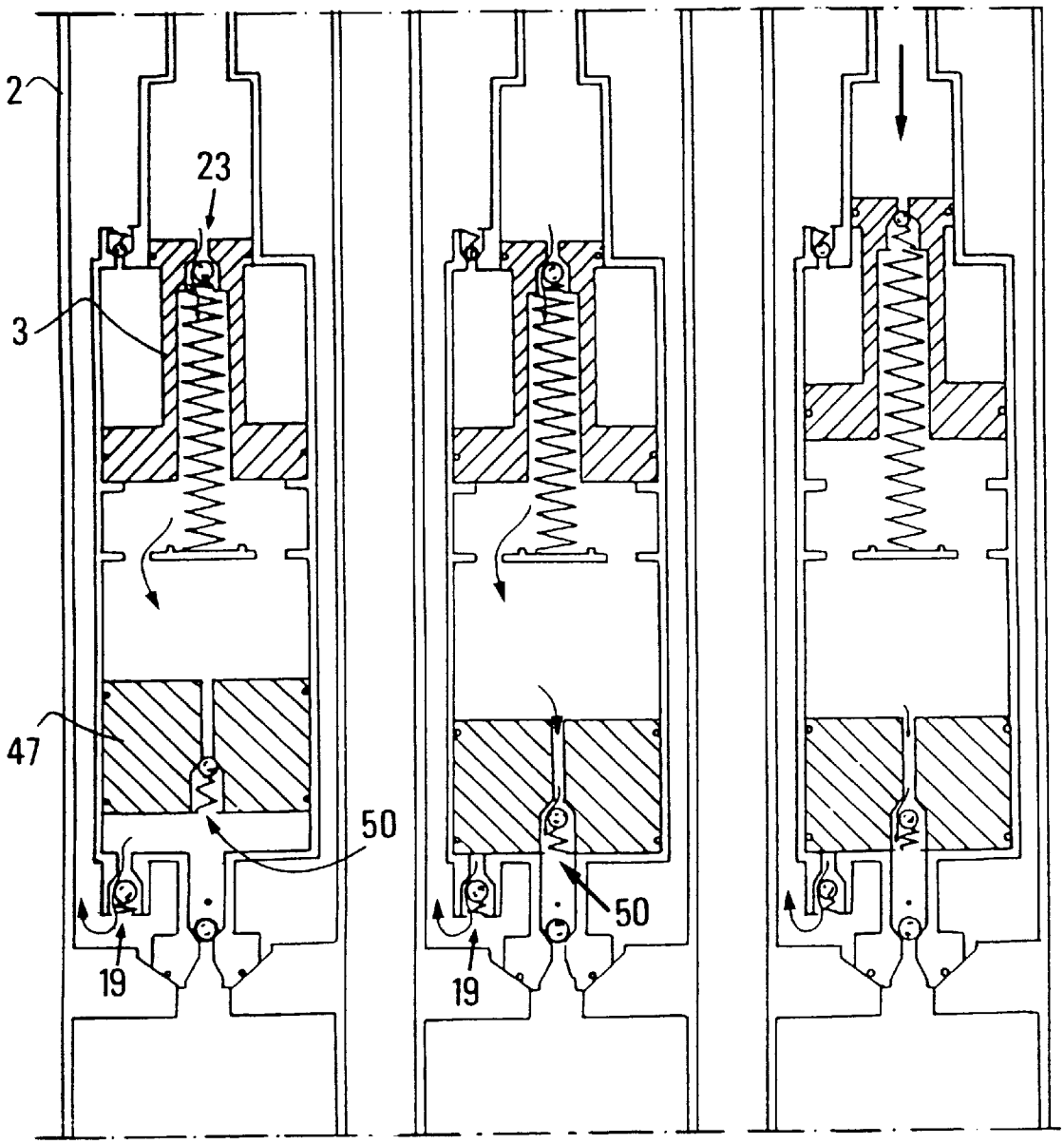
FIGS. 16A through 16F show the principal operating stages of the same free-piston pumping device during the buffer fluid volume regenerating process, and at the stage where the vacuum is being regenerated in the space between the two pressure-reducer pistons.
Figure 16D:
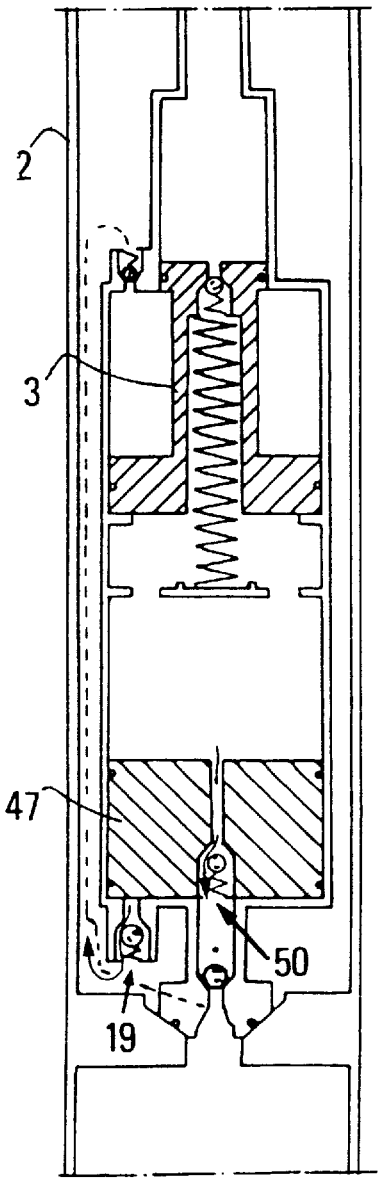
Figure 16E:
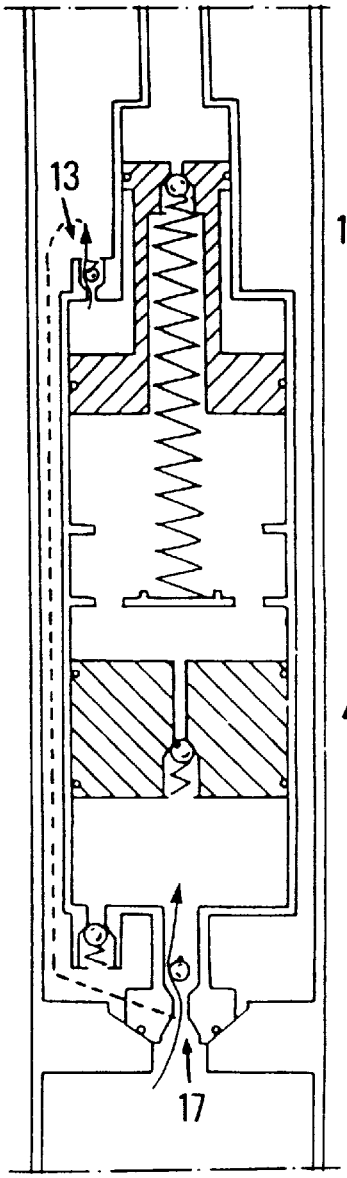
Figure 16F:
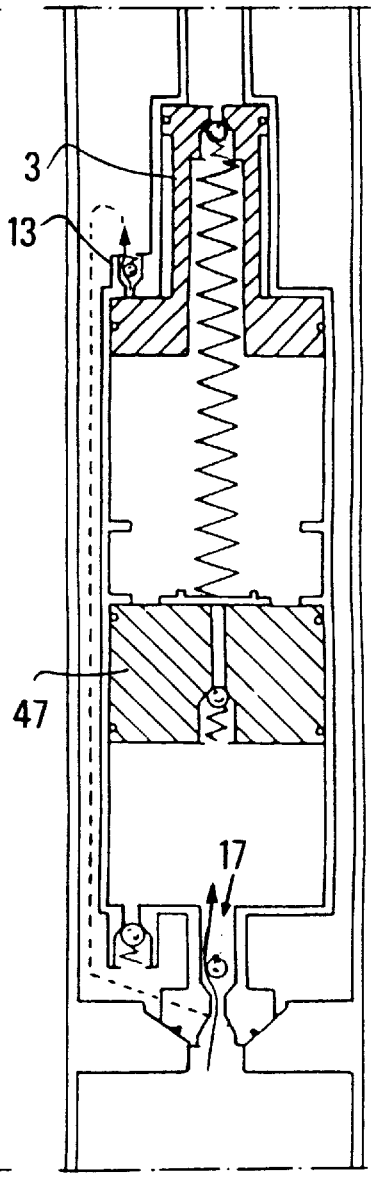

FIG. 14 shows schematically a variant of the system where the drive part is provided with means for installing the entire pumping system at the bottom of a well by wireline.

In this figure, provided as an illustration, lifting is done inside the product tubing, with the drive liquid circulating in the annular space between the product casing and tubing.

The drive part is equipped, at its upper part, with a part 101 connected to a tube 102, the latter being held inside the casing by packers 103. Part 101 has a drive fluid passage 104 going to the drive part and a passage 105 for the fluid pumped by the bottom-hole pump to the inside of the tubing that lifts the product.

FIGS. 15A to 15F represent the principal sequences of a normal pumping cycle showing, according to the position of the double piston of pressure reducer 3, the position of the free piston of pump 43 and the status of the pump suction valve 17 and discharge valve 13.

Finally, FIGS. 16A to 16F show schematically the stages of regeneration of the buffer liquid volume when the latter is contaminated by pumped fluid or when there have been leaks:

during the procedure regenerating the volume of buffer liquid controlled from the surface in the event of loss or gain of this volume possibly caused by leaks in the various valves and gaskets of the pumping device: valves 23, 50, and 19, properly calibrated, enable buffer liquid to be introduced, renewed if it is lacking, or evacuated if it is in excess, during the stages of regeneration of the dead volume between the two pistons of the pressure reducer, particular in the event of wear or lack of tightness of the gaskets of this double piston: the fluids that have invaded this space are evacuated through a calibrated valve 13 preferably connected by a small-diameter tubing 15 with the product tubing below the product suction valve.

The pressure reducer system can be chosen with relatively long travel distances, for example distances greater than one meter, to reduce energy loss by inertia and limit leaks and wear in the valves. Such an embodiment improves pumping efficiency.

The speed of displacement of the pressure reducer piston is preferably less than 1 m/s to reduce the wear on the sliding seals disposed at the device.

The system according to the invention can advantageously be applied to produce small crude-producing wells, for example at the end of well operation.

It adapts readily to different conditions, whatever the pump immersion depth, the bottom temperature and pressure, the deviation of the well, and the nature of the deposit and its environment, and whatever the properties of the crude and the associated phases, provided they abide by the minimum pumping conditions, for example that the sand or sediment content is not excessive and the viscosity of the crude is not too high.

Thus, it applies optimally to producing small producing wells with small depths and sharp deviations.

What is claimed is:

1. A pumping system for pumping fluids at low pressure comprising at least one pumping enclosure, the enclosure comprising at least one pipe for introducing a fluid to be pumped and at least one pipe for discharging the pumped fluid, the at least one pumping enclosure having a pipe which introduces a drive fluid and a pressure-reducer which reduces the pressure of the drive fluid transmitted to the fluid to be pumped, the pressure reducer together with an inside wall of the pumping enclosure forming a space which contains at least reduced pressure or a vacuum and wherein the at least one enclosure comprises a first part and a second part, the parts being connected by a pipe and the first part is a drive part comprising the pressure reducer and is provided with a device which introduces drive fluid and the second part provides two variable-volume chambers one of the chambers being in communication with introduction of pumped fluid and a discharge and another of the chambers being connected with a pipe through which the drive fluid passes.

2. A system according to claim 1, wherein the pressure reducer comprises a vacuum preservation valve.

3. A system according to claim 2, further comprising a return connected to the pressure reducer.

4. A system according to claim 3, wherein:

the pressure reducer has at least a first piston with a section $s_1$ and a second piston with a section $S_2$, the first and the second piston being disposed essentially along one axis, and with a ratio $s_2/s_1$ between the sections $s_1$ and $s_2$ being between 1 and 10.

5. A system according to claim 4 wherein:

the ratio of $s_2/s_1$ is between 1 and 3.

6. A system according to claim 1, wherein:

the pressure reducer has at least a first piston with a section $s_1$ and a second piston with a section $S_2$, the first and the second piston being disposed essentially along one axis, and with a ratio $s_2/s_1$ between the sections $s_1$ and $s_2$ being between 1 and 10.

7. A system according to claim 6 wherein:

the ratio of $s_2/s_1$ is between 1 and 3.

8. A system according to claim 2, wherein:

the pressure reducer has at least a first piston with a section $s_1$ and a second piston with a section $s_2$, the first and the second piston being disposed essentially along one axis, and with a ratio $s_2/s_1$ between the sections $s_1$ and $s_2$ being between 1 and 10.

9. A system according to claim 8 wherein:

the ratio of $s_2/s_1$ is between 1 and 3.

10. A system according to claim 1, wherein:

the second part comprises a deformable flexible membrane disposed essentially along a length of the system.

11. A system according to claim 1, wherein:

the second part comprises a double membrane.

12. A system according to claim 1, wherein:

the second part comprises at least one extensible membrane inflated and folded alternately to create, changes in a chamber volume which provides suction and discharge phases.

13. A system according to claim 1, further comprising:

a device which controls and generates pressure cycles modulated at a surface of a reservoir from which the fluids are pumped.

* * * * *